US006246375B1

(12) United States Patent
Yamada et al.

(10) Patent No.: US 6,246,375 B1
(45) Date of Patent: Jun. 12, 2001

(54) ANTENNA DEVICE AND TRANSMIT-RECEIVE UNIT USING THE SAME

(75) Inventors: Hideaki Yamada, Ishikawa-ken; Fuminori Nakamura; Toru Tanizaki, both of Nagaokakyo; Taiyo Nishiyama, Otsu, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/471,519

(22) Filed: Dec. 23, 1999

(30) Foreign Application Priority Data

Dec. 24, 1998 (JP) ..... 10-367252

(51) Int. Cl.[7] ..... H01Q 19/06

(52) U.S. Cl. ..... 343/754; 343/753; 343/909; 343/911 R

(58) Field of Search ..... 343/753, 754, 343/757, 758, 909, 911 R, 911 L; H01Q 3/12, 3/18, 19/06

(56) References Cited

U.S. PATENT DOCUMENTS 3,775,769 * 11/1973 Heeren et al. ..... 343/754
3,881,178 * 4/1975 Hannan ..... 343/779
4,062,018 * 12/1977 Yokoi et al. ..... 343/754
4,338,607 * 7/1982 Drabowitch ..... 343/754

FOREIGN PATENT DOCUMENTS 19642810 4/1998 (DE) .
0852409 7/1998 (EP) .
0867972 9/1998 (EP) .
0920068 6/1999 (EP) .
0971436 1/2000 (EP) .

* cited by examiner

*Primary Examiner*—Tho G. Phan
(74) *Attorney, Agent, or Firm*—Ostrolenk, Faber, Gerb & Soffen, LLP

(57) ABSTRACT

An antenna device has less change in gain during beam scanning, caused by the displacement of a primary radiator with respect to a dielectric lens, and scanning can be carried out over a large angular range at uniform gain. A primary radiator has a focal plane in a position deviating from the optical axis of a dielectric lens, and when the primary radiator intersects the optical axis, the primary radiator leaves the focal plane. As a consequence, by moving the primary radiator away from the optical axis to other positions, change in the gain caused by change in the open efficiency and aberration can be reduced.

12 Claims, 5 Drawing Sheets

ANTENNA DEVICE AND TRANSMIT-RECEIVE UNIT USING THE SAME

BACKGROUND OF THE INVENTION

1. Field of the Invention

The present invention relates to an antenna device for millimeter wave band or the like comprising a dielectric lens and a primary radiator, and also relates to a transmit-receive unit using the antenna device.

2. Description of the Related Art

Radar for a vehicle, using the millimeter wave band, for example, radiates a highly directed radar beam forward or rearward of the vehicle, receives waves reflected from a target such as another vehicle traveling in front of or behind the vehicle, and determines the distance to the target and its speed relative to the vehicle itself based on time delay, frequency difference, and the like, between the radiated and received signals. In a millimeter wave radar of this type, when a scan is to be conducted across a small angular range, the radar need only to radiate the transceiver beam in a fixed direction. In contrast, when scanning is to be conducted across a large angular range, the radar must change the direction of the beam while maintaining a high directivity so as to maintain high gain without reducing the resolution.

Accordingly, in a conventional millimeter wave antenna device, such as that shown in FIG. 7, a dielectric lens 2 and a primary radiator 1 constitute a single antenna device, and the direction of the beam is changed by changing the relative position of the primary radiator 1 with respect to the dielectric lens 2. In FIG. 7, reference numerals 1*a,* 1*b,* and 1*c* simultaneously represent three positions during the beam scanning of a single primary radiator. When the primary radiator 1 is at position 1*a,* the beam is formed as shown by Ba; when the primary radiator 1 is at position 1*b,* the beam is formed as indicated by Bb; and when the primary radiator 1 is at position 1*c,* the beam is formed as indicated by Bc. FIG. 8 shows an example of changes in the beam depending on the position of the primary radiator 1.

Since the above-mentioned dielectric lens is a rotationally symmetric body having its central axis as its center, a focal point is normally created on this central axis (hereinafter termed the "optical axis"), and the resulting beam is most focused when the phase center of the primary radiator is at the focal position. In the example shown in FIG. 7, the beam Bb, formed when the primary radiator is at the position indicated by 1*b,* is focused and is obtained with high gain. The further the phase center of the primary radiator deviates from the focal point, the wider the beam (half-value angle), and the weaker the emission, with a consequent reduction in the gain. Accordingly, in general, the phase center of the primary radiator is moved along the plane (hereinafter termed the "focal plane") perpendicular to the optical axis passing through the focal point, and tracking is performed keeping the beam as focused as possible, thereby preventing a reduction in gain.

However, when there is a need to widen the angle of the beam scanning, the displacement of the primary radiator increases, and is inclined greatly with respect to the optical axis of the dielectric lens. As a result, the open efficiency of the dielectric lens decreases. In addition, the effects of aberration increase, greatly changing the gain of the antenna. Furthermore, even when the angular range of the beam scanning is relatively small, when a more uniform gain is required, there is still the problem of changes in gain due to the displacement of the primary radiator.

SUMMARY OF THE INVENTION

The present invention provides an antenna device wherein changes in gain during beam scanning, resulting from displacement of a primary radiator with respect to a dielectric lens, are reduced, and a transmit-receive unit which can scan over a large angular range with uniform gain.

The antenna device of the present invention comprises a dielectric lens, a primary radiator and a primary radiator displacement device to relatively displace the primary radiator with respect to the dielectric lens and change the directivity direction of a beam in accordance with the displacement of the relative positions of the phase center of the primary radiator and the dielectric lens. The primary radiator displacement device displaces the primary radiator so that the path of movement of the phase center of the primary radiator is not parallel to the focal plane of the dielectric lens. As a consequence, unlike the case where the primary radiator is only displaced on the focal plane, fluctuation in the open efficiency and aberration of the dielectric lens due to the displacement of the primary radiator, can be controlled.

The primary radiator displacement device displaces the primary radiator so that the phase center of the primary radiator moves farther away from the focal plane as it moves closer to the optical axis of the dielectric lens. Furthermore, a focal point is created substantially on the path of motion of the phase center of the primary radiator, and in addition, at a position removed from the center axis of the dielectric lens. As a consequence, it is possible to control fluctuation in the antenna gain arising as a result of fluctuation in the open efficiency and aberration of the dielectric lens due to the displacement of the primary radiator.

Moreover, a transmit-receive unit of the present invention comprises the antenna device described above, an oscillator for generating a transmission signal to the antenna device, and a mixer for mixing a received signal from the antenna device with a local signal. As a consequence, it is possible to scan for a target, with stable gain, irrespective of the search direction.

BRIEF DESCRIPTION OF THE DRAWING(S)

DETAILED DESCRIPTION OF EMBODIMENTS OF THE INVENTION

A first preferred embodiment of the antenna device of the present invention will be explained with reference to FIGS. 1 to 3.

Figure 1:
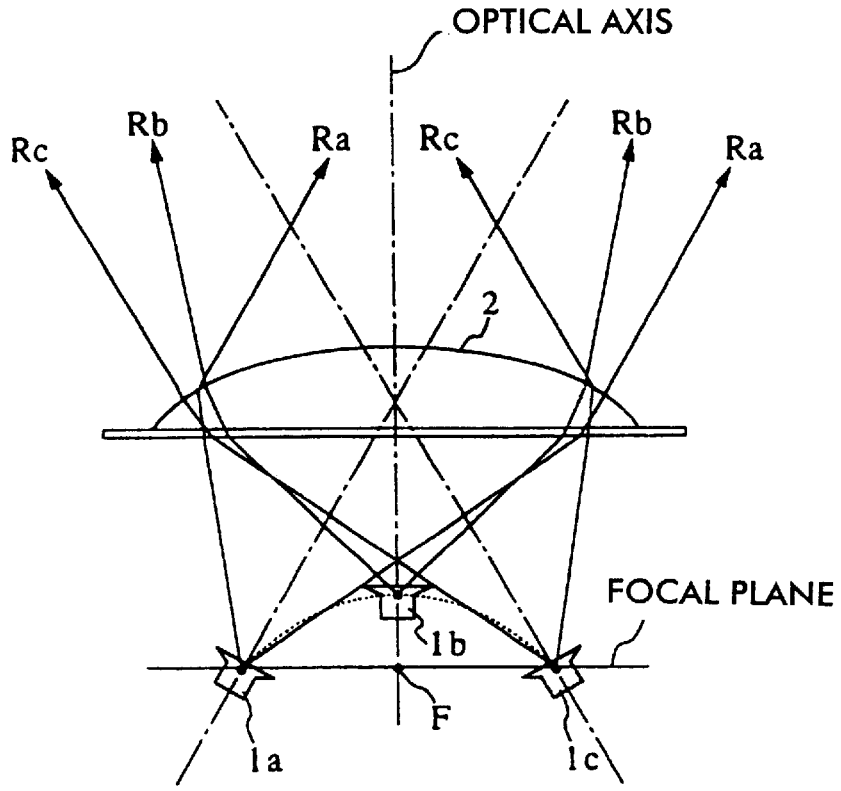
FIG. 1 is a diagram showing the positional relationship between a dielectric lens and a primary radiator of the antenna device according to a first embodiment.

FIG. 1 shows an example of the displacement of a primary radiator during beam scanning. There is actually only one primary radiator, and the reference numerals 1*a,* 1*b,* and 1*c* in the diagram represent three positions of the primary radiator 1 during beam scanning. In FIG. 1, the primary radiator is displaced by a mechanism having a rotating motor as its drive source, or by a mechanism having a linear motor as its drive source. Reference symbols Ra, Rb, and Rc show rays when the primary radiator is positioned at 1*a,* 1*b,* and 1*c* respectively. When the primary radiator at position 1*b* is on the optical axis of a dielectric lens 2, the beam is relatively wide, as shown by reference symbol Rb. When the primary radiator is at the position 1*a,* the rays Ra and Ra are substantially parallel, and form a focused beam. Similarly, when the primary radiator is at the position 1*c,* the rays Rc and Rc are substantially parallel and form a focused beam.

The open efficiency of the dielectric lens 2 is highest when the primary radiator is on the optical axis, as indicated by 1*b*. The open efficiency of the dielectric lens 2 decreases as the primary radiator moves away from the optical axis, as indicated at 1*a* and 1*c*. Here, "open efficiency" means the relative ratio of the cross-sectional area perpendicular to the convergence of rays, which affects image formation at the optical axis outside point (the phase center of the primary radiator), with respect to a similar cross-sectional area of the convergence of rays, which affects image formation at points on the optical axis, when the primary radiator is on the optical axis as indicated at 1*a* and 1*c*. Therefore, the farther the optical axis outside point moves away from the optical axis, the more the open efficiency decreases (that is, the area of the shape (elliptical shape), when the lens is viewed from that point, decreases). Furthermore, the more the phase center of the primary radiator deviates from the optical axis, the more the beam widens as a result of aberration, whereby the gain decreases.

Figure 2:
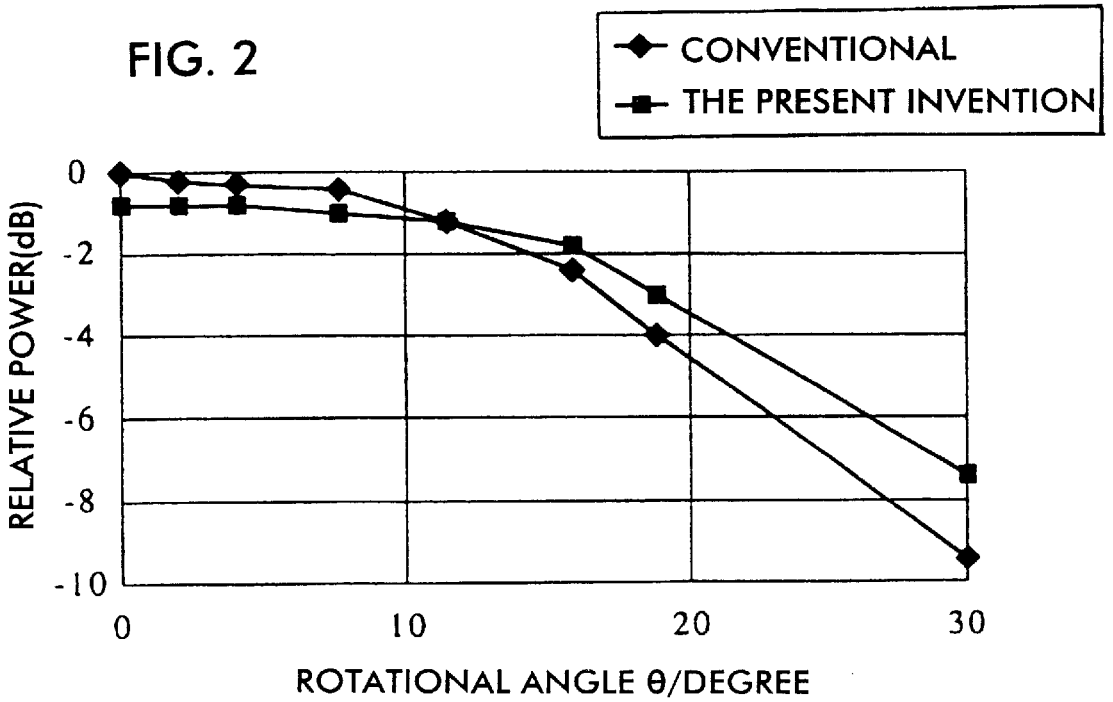
FIG. 2 is a diagram showing changes in gain during beam scanning in the antenna device and a conventional antenna device.
Figure 3:
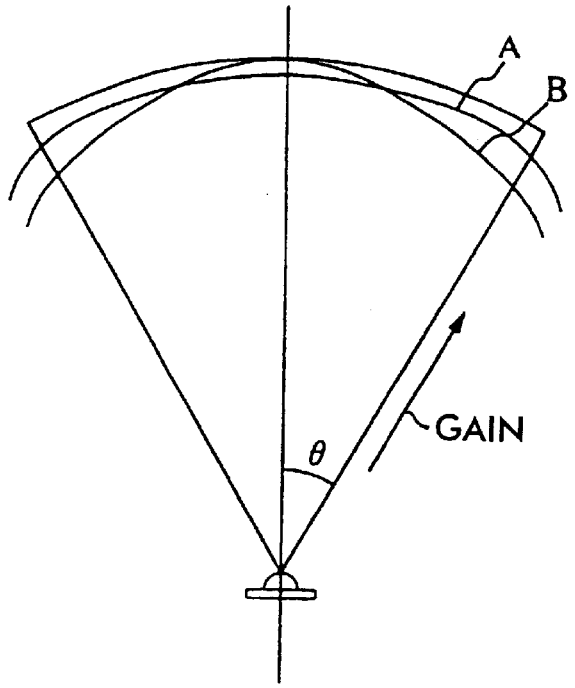
FIG. 3 is a diagram showing changes in gain during beam scanning in the antenna device and a conventional antenna device.

FIG. 2 shows the relationship between gain deterioration and the angle of rotation of a rotating body for displacing the antenna device shown in FIG. 1, in comparison with that of a conventional antenna device. Furthermore, FIG. 3 shows the loci when gain is represented by the length of the emission direction in correspondence with the tracking of the center axis of the beam by the displacement of the primary radiator. In FIG. 3, reference symbol A represents the antenna device according to the present invention shown in FIG. 1, and reference symbol B represents characteristics of a conventional antenna device. According to the present invention, when the primary radiator is on the optical axis, the phase center of the primary radiator has deviated in the axial direction from the focal position of the dielectric lens. Consequently, gain is lower than in the conventional antenna device. However, when the primary radiator is displaced as far as possible from the optical axis, the phase center of the primary radiator arrives on the focal plane. Consequently, the decrease in gain is better than in the conventional antenna device. As a consequence, there is only a slight change in the gain decrease when the primary radiator has been displaced in order to perform beam scanning. In contrast, in the conventional antenna device, the highest gain is obtained when the primary radiator is on the optical axis, but when the primary radiator is displaced in order to perform beam scanning, the gain abruptly decreases.

Figure 4:
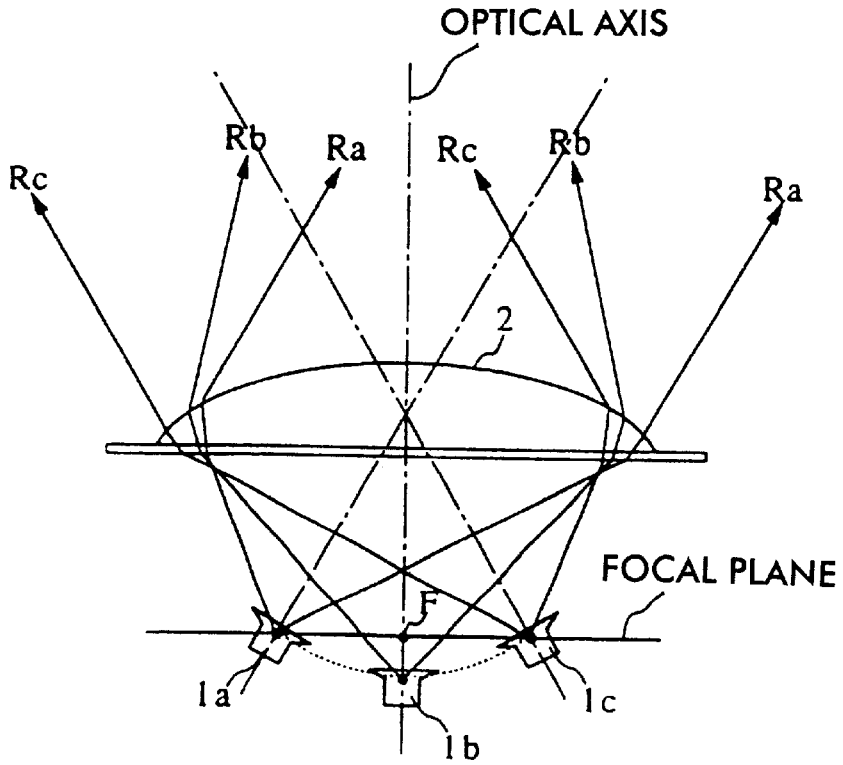
FIG. 4 is a diagram showing the positional relationship between a dielectric lens and a primary radiator of the antenna device according to a second embodiment.

Next, a second embodiment of the antenna device according to the present invention will be explained with reference to FIG. 4.

FIG. 1 shows an example in which, when the primary radiator is on the optical axis, the primary radiator is displaced from the focal point of the dielectric lens to a position nearer the dielectric lens. Conversely, in FIG. 4, when the primary radiator reaches the optical axis, it moves from the focal point F to arrive at a position more distant from the lens. That is, when the primary radiator 1*b* is on the optical axis of the dielectric lens 2, the beam is relatively wide as indicated by Rb. When the primary radiator is at the position shown by 1*a,* the rays Ra and Ra are substantially parallel, and form a focused beam. Similarly, if the primary radiator is at the position indicated by 1*c,* the rays Ra and Rc are substantially parallel, and form a focused beam.

Figure 5:
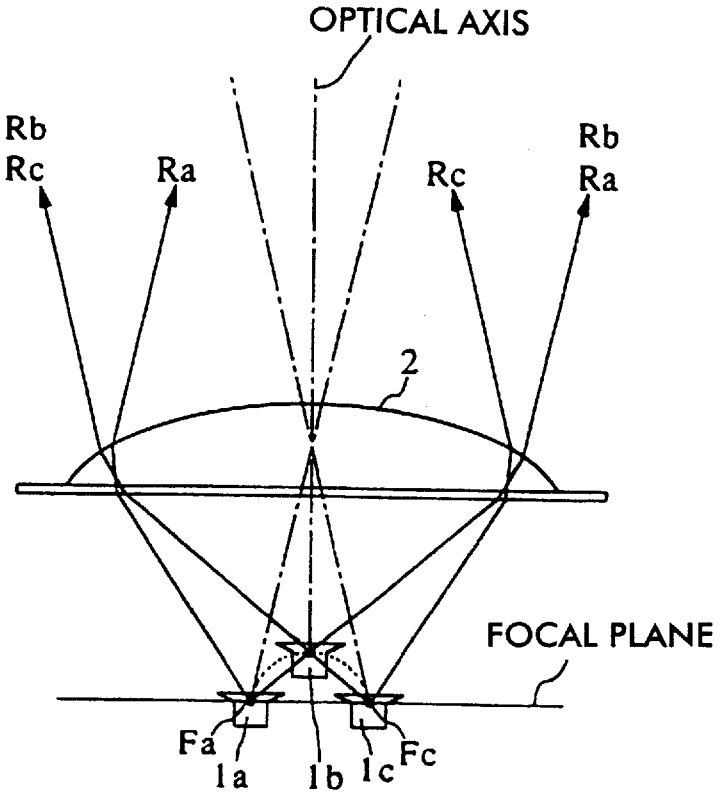
FIG. 5 is a diagram showing the positional relationship between a dielectric lens and a primary radiator of the antenna device according to a third embodiment.

Next, FIG. 5 shows an antenna device according to a third embodiment of the present invention. The present embodiment differs from the first and second embodiments in that, instead of a normal lens having its focal point on the center axis of the dielectric lens, a dielectric lens having multiple focal points comprising multiple points which are not on the optical axis, is used. In the example shown in FIG. 5, reference symbols Fa and Fb represent focal points, and the beam is most focused when the primary radiator is positioned at 1*a* or 1*c*. When the primary radiator is positioned at 1*b,* it has moved away from the focal point of the dielectric lens 2, and consequently the gain can be reduced by a corresponding amount. Overall, the path of motion of the primary radiator with respect to the focal plane should be determined so that change in the gain decreases as the primary radiator is displaced.

Since this example uses multiple focal points, the primary radiator may, for instance, be displaced on the focal plane shown in FIG. 5. In this case, even when the primary radiator is on the optical axis (center axis), since it is not at the focal position, its gain can be controlled, thereby enabling the overall change in gain to be reduced.

In each of the embodiments described above, the primary radiator is most displaced at the position of the focal point of the dielectric lens. However, the path of motion of the primary radiator need only be determined so as to reduce change in the gain caused by changes in the open efficiency and aberration due to the displacement of the primary radiator. Therefore, the path of motion of the primary radiator may, for example, cut across the focal plane.

Next, a transmit-receive unit using millimeter wave radar will be explained with reference to FIG. 6.

Figure 6:
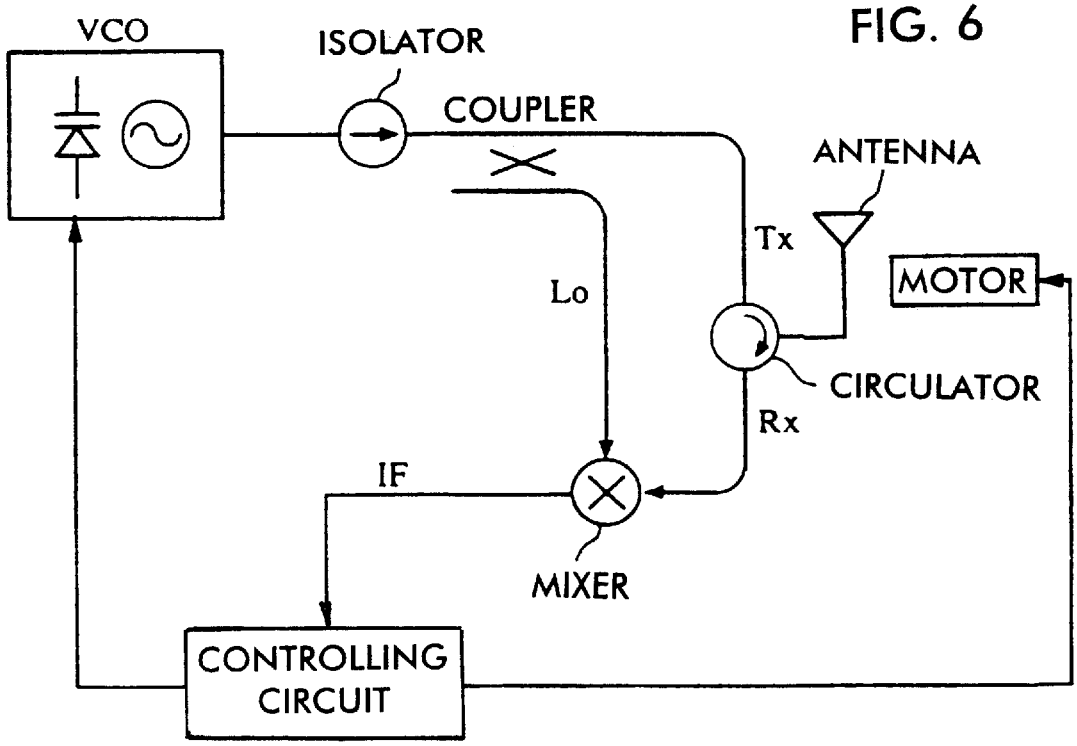
FIG. 6 is a block diagram showing a transmit-receive unit using millimeter wave radar.
Figure 7:
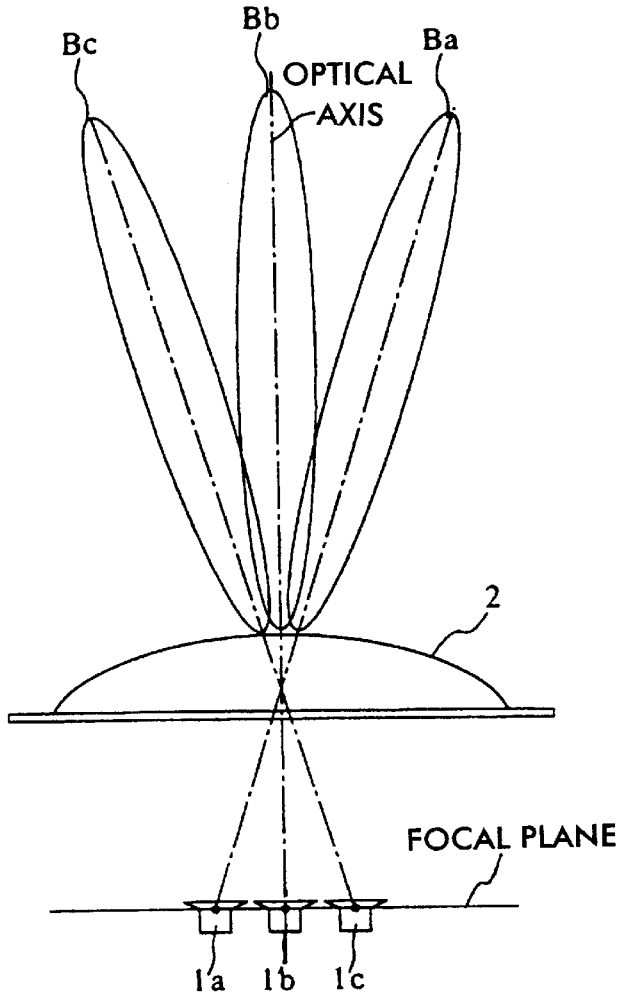
FIG. 7 PRIOR ART
FIG. 7 is a diagram showing the positional relationship between a dielectric lens and a primary radiator in a conventional antenna device, and an example of a beam determined thereby.
Figure 8:
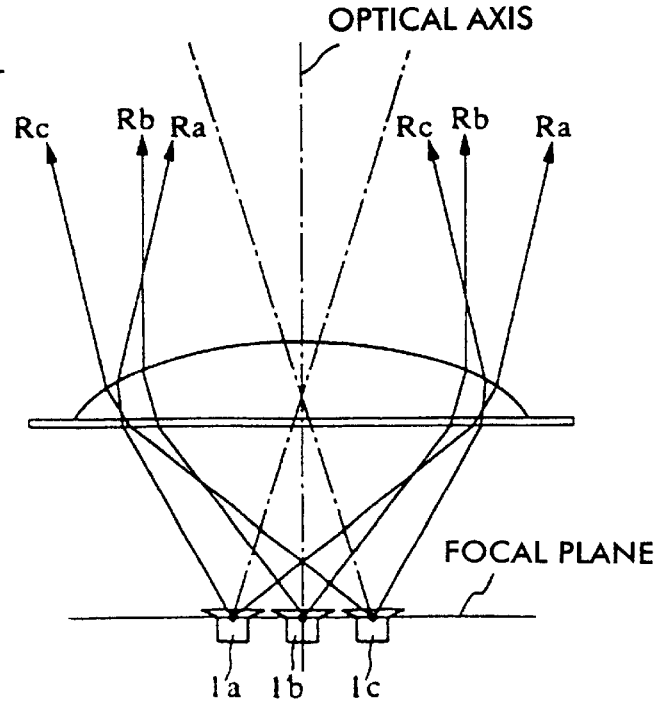
FIG. 8 PRIOR ART
FIG. 8 is a diagram showing the positional relationship between a dielectric lens and a primary radiator in a conventional antenna device.

In FIG. 6, the antenna device comprises the primary radiator 1 and the dielectric lens 2 described above. In FIG. 6, a signal output from a VCO is sent to the antenna along a path comprising an isolator, a coupler and a circulator, and the signal received at the antenna is supplied via the circulator to a mixer. Furthermore, the mixer mixes the received signal RX with a local signal Lo distributed at the coupler, and outputs the frequency difference between the transmitted signal and the received signal as an intermediate-frequency signal IF. A controller drives a motor to displace the primary radiator of the antenna device, modulates the oscillating signal of the VCO, and determines the distance and relative speed to the target based on the IF signal. The controller also determines the direction of the target based on the position of the primary radiator.

According to the present invention, it is possible to control fluctuation in the open efficiency and aberration of the dielectric lens caused by the displacement of the primary radiator. This is not possible when the primary radiator is only displaced on the focal plane.

Furthermore, it is possible to control fluctuation in the antenna gain caused by open fluctuation in the efficiency and aberration of the dielectric lens due to the displacement of the primary radiator.

Moreover, it is possible to search for a target, with stable gain, irrespective of the direction scanned.

Figure 10:
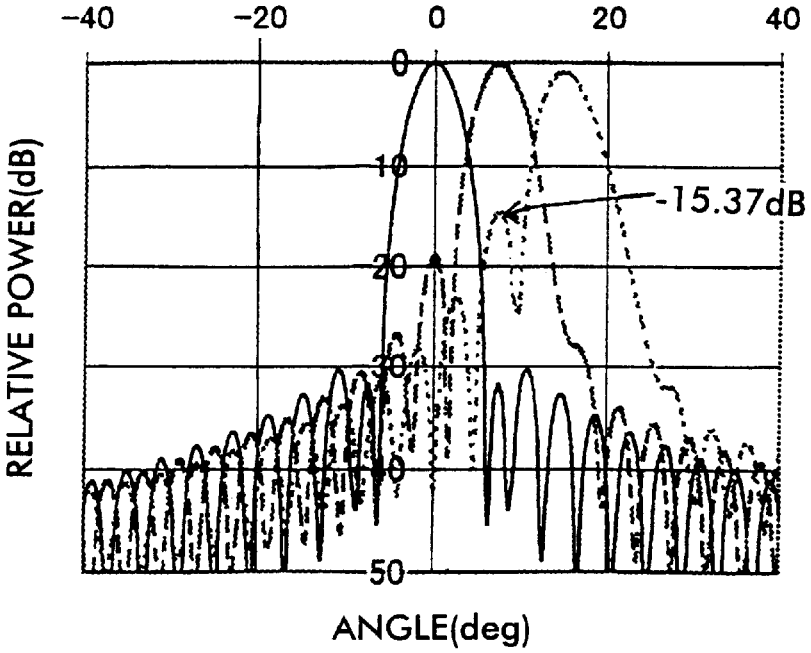
FIG. 10 PRIOR ART
FIG. 10 is a graph showing intensity of radiation from the antenna according to the present invention.

Further, the present invention contributes to improvement in directivity of an antenna. FIG. 10 shows the intensity of radiation from the antenna device according to the present invention. When the angle between a line along to the optical axis and a line connecting the focal point F with an observing position in front of the lens 2 is zero, a maximum relative power is observed. Solid line, dashed line and dotted line represent the intensity of the radiation observed when the primary radiator is located at position 1*b,* a middle position between 1*c* and 1*b* and position 1*c* respectively. There are small peaks associated with the central main peak. The intensity of the small peaks tends to increase when the primary radiator is displaced. However, according to the present invention, the increase of the side peaks can be reduced. When the primary radiator is at the position 1*c* (dotted line), the side peak associated with the main peak exhibits the level of 15.37 dB.

Figure 9:
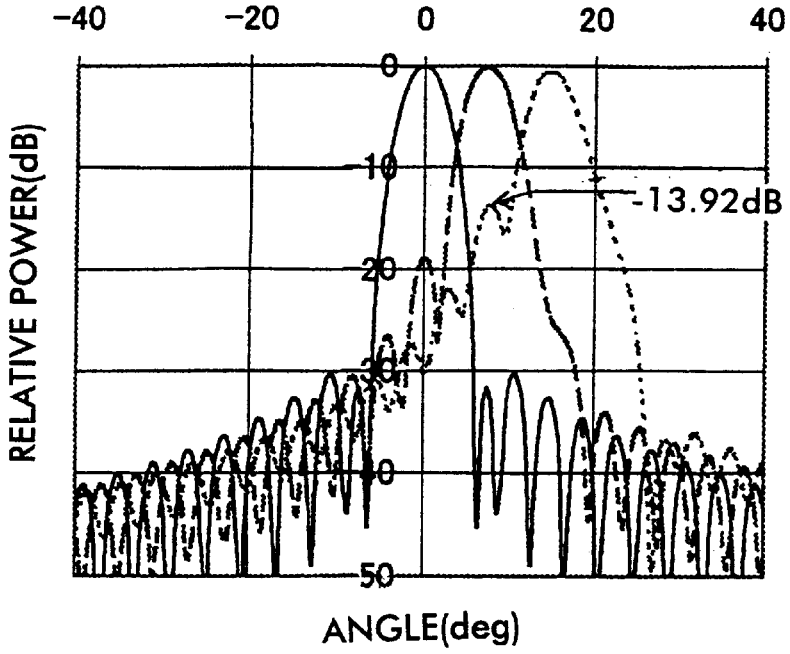
FIG. 9 PRIOR ART
FIG. 9 is a graph showing intensity of radiation from the conventional antenna shown in FIGS. 7 and 8.

FIG. 9 shows the intensity of radiation from the conventional antenna device 7. When the angle between a line along the optical axis and a line connecting the focal point F with an observing position in front of the lens 2 is zero, a maximum relative power is observed. Solid line, dashed line and dotted line represent the intensity of the radiation observed when the primary radiator is located at position 1*b,* a middle position between 1*c* and 1*b* and position 1*c* respectively. When the primary radiator is at the position 1*c* (dotted line), the side peak associated with the main peak exhibits the level of 13.92 dB.

Accordingly, the intensity of side peaks can be effectively reduced in accordance with the present invention.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An antenna device comprising:

a dielectric lens having a focal plane substantially parallel to a surface of the dielectric lens, the dielectric lens further having an optical axis substantially perpendicular to the focal plane;

a primary radiator having a phase center, and a primary radiator displacement device relatively displacing said primary radiator with respect to said dielectric lens, and changing a directivity direction of a beam of energy from said primary radiator in accordance with the displacement of relative positions of the phase center of the primary radiator and said dielectric lens;

said primary radiator displacement device displacing the primary radiator so that a path of motion of the phase center of said primary radiator is not parallel to the focal plane of said dielectric lens.

2. The antenna device of claim 1, wherein said primary radiator displacement device displaces the primary radiator so that the phase center of said primary radiator moves further away from said focal plane as the primary radiator moves closer to the optical axis of said dielectric lens.

3. The antenna device of claim 2, wherein at least one focal point is created substantially on the path of motion of the phase center of said primary radiator, and further, at a position removed from the optical axis of said dielectric lens.

4. The antenna device of claim 2, wherein the phase center moves toward said dielectric lens as the phase center approaches the optical axis.

5. The antenna device of claim 2, wherein the phase center moves further away from the dielectric lens as the phase center approaches the optical axis.

6. The antenna device of claim 1, wherein at least one focal point is created substantially on the path of motion of the phase center of said primary radiator, and further, at a position removed from the optical axis of said dielectric lens.

7. A transmit-receive unit comprising:

an antenna device comprising:

a dielectric lens having a focal plane substantially parallel to a surface of the dielectric lens, the dielectric lens further having an optical axis substantially perpendicular to the focal plane;

a primary radiator having a phase center, and a primary radiator displacement device relatively displacing said primary radiator with respect to said dielectric lens, and changing a directivity direction of a beam of energy from said primary radiator in accordance with the displacement of relative positions of the phase center of the primary radiator and said dielectric lens;

said primary radiator displacement device displacing the primary radiator so that a path of motion of the phase center of said primary radiator is not parallel to the focal plane of said dielectric lens; and an oscillator for generating a transmission signal for the antenna device, and a mixer for mixing a receive signal from said antenna device with a local signal.

8. The transmit-receive unit of claim 7, wherein said primary radiator displacement device displaces the primary radiator so that the phase center of said primary radiator moves further away from said focal plane as the primary radiator moves closer to the optical axis of said dielectric lens.

9. The transmit-receive unit of claim 8, wherein at least one focal point is created substantially on the path of motion of the phase center of said primary radiator, and further, at a position removed from the optical axis of said dielectric lens.

10. The transmit-receive unit of claim 8, wherein the phase center moves toward said dielectric lens as the phase center approaches the optical axis.

11. The transmit-receive unit of claim 8, wherein the phase center moves further away from the dielectric lens as the phase center approaches the optical axis.

12. The transmit-receive unit of claim 7, wherein at least one focal point is created substantially on the path of motion of the phase center of said primary radiator, and further, at a position removed from the optical axis of said dielectric lens.

* * * * *